US005108260A

United States Patent [19]

Monrose, III et al.

[11] Patent Number: 5,108,260

[45] Date of Patent: Apr. 28, 1992

[54] ARTICULATED MOUNTING BRACKET FOR CEILING FANS

[76] Inventors: Ernest W. Monrose, III; Ernest W. Monrose, IV, both of 3872 - 50th Ave. S., St. Petersburgh, Fla. 33711-4866

[21] Appl. No.: 602,012

[22] Filed: Oct. 23, 1990

[51] Int. Cl.[5] ..... F04D 29/26

[52] U.S. Cl. ..... 416/142; 416/204 R; 403/102

[58] Field of Search ..... 416/5, 87, 89, 142, 416/143, 204 R, 210 R; 403/100, 102

[56] References Cited

U.S. PATENT DOCUMENTS

| | | | |
|---|---|---|---|
| 213,644 | 3/1879 | Feldman et al. | 416/142 |
| 474,141 | 5/1982 | Morton | 416/142 |
| 1,361,785 | 12/1920 | Tucker | 416/87 |
| 1,728,768 | 9/1929 | O'Connor | 415/140 |
| 4,776,761 | 10/1988 | Diaz | 416/142 |

*Primary Examiner*—Edward K. Look

*Assistant Examiner*—James A. Larson

*Attorney, Agent, or Firm*—Joseph C. Mason, Jr.; Ronald E. Smith

[57] ABSTRACT

A mounting bracket for a ceiling fan blade is cut into two separate pieces that are pivotally interconnected to one another so that the blade is pivotal in either of two directions about the pin. A lock ring is positioned radially outwardly of the pivot point to lock the blade into its operable position. Rotation of the lock ring until a slot formed in the lock ring is in alignment with the mounting bracket neck frees the mounting bracket to pivot downwardly, facilitating cleaning of the blade. In a second embodiment, a mounting bracket releasably couples together inward and outward parts of the mounting bracket so that the fan blade is completely detachable from the motor assembly to facilitate cleaning of the blade. In a third embodiment, a bag having cleaning pads at its mouth is used to clean either the pivotally mounted blade or the releasably coupled blade.

3 Claims, 3 Drawing Sheets

ARTICULATED MOUNTING BRACKET FOR CEILING FANS

TECHNICAL FIELD

This invention relates, generally, to improvements in ceiling fans. More particularly, it relates to a ceiling fan construction where the mounting brackets for the blades are foldable to facilitate cleaning of the blades.

BACKGROUND ART

The blades of ceiling fans accumulate dust and dirt particles rather quickly and frequent cleaning is required. Failure to clean the blades results in poor fan performance. Moreover, the rotating blades distribute dust and dirt throughout the room until cleaned.

Some inventors have developed blade cleaning brushes that clean the blades while the blades are in their operative position. These devices require the individual performing the cleaning chore to reach up with the blade cleaning device, align it with the free end of the blade, and oscillate the device along the extent of the blade being cleaned. This tires the individual's arm, neck and shoulder muscles. Perhaps even more importantly, such cleaning may simply transfer dirt from the blades to the floor below the fan.

Accordingly, some inventors have developed fan blades that can be folded downwardly to facilitate their cleaning. An example of such devices is shown in U.S. Pat. No. 4,776,761 to Diaz. Additional fans having foldable blades are shown in U.S. Pat. No. 1,728,768 to O'Conner, U.S. Pat. No. 1,361,785 to Tucker, and U.S. Pat. No. 474,141 to Morton.

All of these earlier articulated fan blades share a common limitation: they either have utility only in connection with a particular fan design or they are limited to a single direction of rotation. Since fan designs differ, there is a need for a more universal foldable fan blade construction. For example, fan constructions include two major categories, i.e., top-mounted blades and bottom-mounted blades. These types relate to the position of the blades relative to the motor housing. More particularly, most motor housings are generally disc-shaped and lie in a horizontal plane. Most of the designs of the prior art have utility in connection with bottom-mounted blades, but no utility in top-mounted designs because the motor housing interferes with the downwardly folded blades. The only known top-mounted foldable fan (Diaz) can rotate in one direction only because reverse rotation causes its blades to fold downwardly.

The prior art, taken as a whole, neither teaches nor suggests to one of ordinary skill in this art how a fan blade could be provided that would be foldable downwardly even in a top-mounted design.

There is also a need for fan blades that detach from their mounting brackets to facilitate their cleaning. However, the art appears to be devoid of any teachings or suggestions of detachable fan blades.

Finally, there is a need for an improved device having specific utility in connection with the cleaning of fan blades of the type that are foldable, but the prior art also appears to be devoid of any such cleaning devices.

DISCLOSURE OF INVENTION

The longstanding but heretofore unfulfilled need for an articulated fan blade mounting bracket that can be folded downwardly relative to a horizontal plane, even if the blades are mounted above the motor housing, is now fulfilled by a mounting bracket construction that includes a pivotally mounted neck which is easily locked into its operable position and just as easily unlocked to permit downward folding of blades, even if said blades are top-mounted.

More specifically, the radially inward or motor end of a novel blade mounting bracket has a slot formed therein coincident with its longitudinal axis of symmetry. The radially outward or fan blade end of the mounting bracket has a corresponding projection that extends radially inwardly and which is loosely received within said slot.

A bore is formed in the base of the slot and the free end of the projection and said bore receives a pin therethrough, said pin having its opposite ends secured within the radially inward part of the blade mounting bracket. Thus, the projection and the blade held by the radially outward part of the mounting bracket are pivotal about the pin.

A generally toroidal-in-configuration lock ring is positioned radially outwardly of the pin to prevent rotation of the projection about the pin when the blade is in its unfolded, operable configuration. The lock ring is rotatably mounted and is discontinuous along a predetermined circumferential extent to provide a slot so that when rotated until the slot is in registration with the projection, then the projection escapes from the confines of the lock ring and is free to rotate about the pin.

In an alternative embodiment, the mounting bracket has a radially inward part and a radially outward part that are releasably coupled to one another so that the blade carried by the radially outward part can be completely disconnected from the motor part of the fan to facilitate cleaning of said blade.

An elongate bag having a length at least sufficient to receive a fan blade therein has cleaning pad means attached at its mouth so that a downwardly folded blade can be cleaned by inserting it into the bag and wiping it with the cleaning pad means so that dirt thereby removed is directed into the bag.

It should therefore be understood that the primary object of this invention is to provide an articulated mounting bracket assembly for top or bottom-mounted ceiling fan blades that are foldable downwardly.

Additional important objects are to provide removable fan blades and novel means for cleaning foldable fan blades.

These and other objects, advantages and features of the invention will become apparent as this description proceeds.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODE FOR CARRYING OUT THE INVENTION

Figure 1:
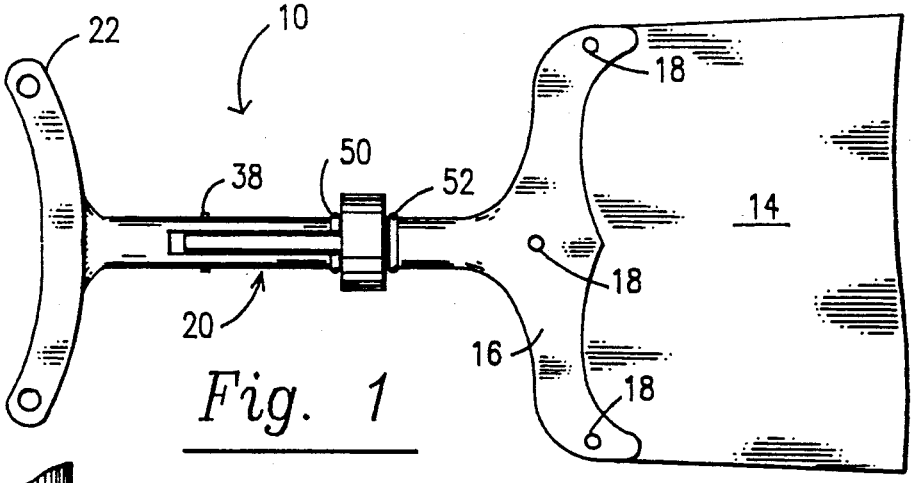
FIG. 1 is a plan view of the articulated mounting bracket of the first embodiment of this invention.

Referring now to FIG. 1, it will there be seen that an exemplary embodiment of the invention is denoted as a whole by the reference numeral 10.

Fan blade 12 is of conventional construction. Its proximal or radially innermost end 14 is fixedly secured to mounting bracket 16 by screws or other suitable fastening means, collectively denoted 18.

Figure 2:
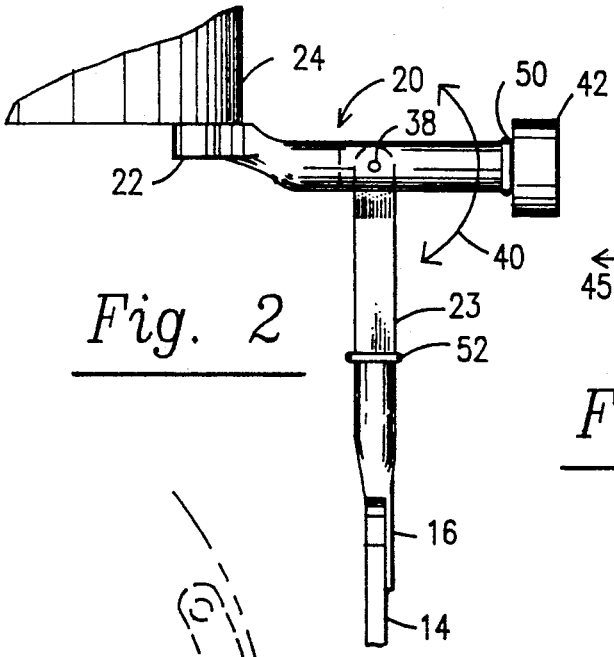
FIG. 2 is a side elevational view of the articulated mounting bracket when a fan blade is folded downwardly.

Mounting bracket 16 includes an elongate narrow part or neck, denoted 20 as a whole, and a base 22 that is secured to a rotatable drive ring 21 (see FIGS. 11 and 12) that is driven by the output shaft (not shown) of a fan motor (not shown) that is positioned within housing 24 (FIG. 2). Housing 24, the drive ring 21, and base 22 are of conventional construction; neck 20 is not. Commercial necks are simply rigid rods that interconnect blade 12 and base 22. Note in FIGS. 11 and 12 that the drive ring 21 may be positioned above or below housing 24. It should also be understood that the motor ends of each blade are secured to said drive ring in circumferentially spaced relation to one another.

Figure 3:
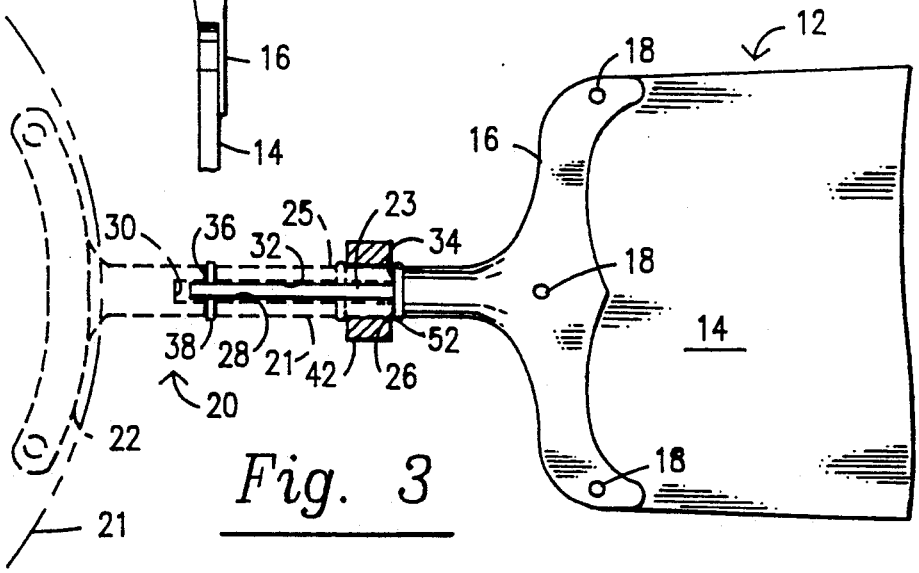
FIG. 3 is a plan view of the mounting bracket with its blade end shown in solid lines and its motor end shown in dotted lines.

The novel neck 20 may be thought of as using a conventional neck as its starting material. As perhaps best shown in FIG. 3, the distal (fan blade) end of neck 20 is separated from the proximal (motor) end thereof by a cut that begins near the blade end of the neck and extends about one-third of the way through the neck as at 26. The cut then extends radially inwardly a predetermined distance, i.e., toward the motor end of the blade, as at 28. The cut then extends transversely about one-third the diameter of neck 20 as at 30, and then extends radially outwardly as at 32 until it is radially coincident with cut 26, and from that point the cut extends transversely about one-third the diameter of neck 20 as at 34, thereby separating the motor end of the neck from the fan end thereof. These cuts may be thought of as forming a radially extending slot in neck 20 that is coincident with the longitudinal axis of the neck and as forming a projection that is loosely received in said slot.

These cuts divide neck 20 into sections 21, 23 and 25; sections 21 and 25 flank the slot that loosely receives projection 23.

Although transverse cuts 26, 30 and 34 have been disclosed as being each about one-third the transverse extent of neck 20, those fractions are believed to be optimal from a design standpoint but other cut extents are within the scope of this invention. For example, cuts 26 and 34 could each extend about one-fourth the transverse extent of neck 20, and cut 30 would then extend one-half of said extent, thereby doubling the breadth of projection 23, and so on.

A transversely extending bore 36 (FIG. 3) is formed in neck 20 near its motor end, and a pin 38 (FIGS. 1 and 2) extends therethrough to interlock the motor and fan blade ends of said neck. It should be understood at this point that blade 12 is free to pivot about pin 38 in either an upwardly or downwardly direction as indicated by the double-headed directional arrow 40 in FIG. 2, although an upward pivotal motion would seldom, if ever, be required.

Lock ring 42 (FIGS. 1–5) is employed to prevent unwanted rotation of neck 20 about pivot pin 38. It is selectively positioned radially outwardly of pin 38 and thus cooperates with said pin to hold neck 20 and hence blade 12 in a horizontal plane just as if neck 20 had not been cut into two separate parts.

Figure 4:
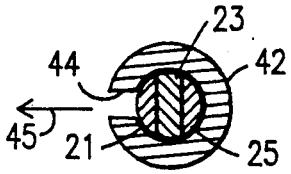
FIG. 4 is an end view of the lock ring when a fan blade is in its operable or horizontal configuration.
Figure 5:
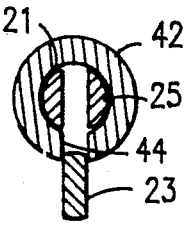
FIG. 5 is an end view of the lock ring that allows the fan blade to be folded downwardly.

Lock ring 42 is split as at 44 to provide a slot or passageway means for selectively unlocking the blade so that it can hang downwardly as depicted in FIG. 2. As depicted in FIG. 4, the split part or passageway 44 of the ring is positioned at 9:00 when it is desired to maintain blade 12 in a horizontal plane, i.e., in its operable position, and when said blade is rotating in the direction indicated by directional arrow 45. Slot 44 would be positioned at a 3:00 position if the blades rotate in an opposite direction. If slot 44 is not positioned to face the direction of rotation, the fan may become unbalanced. To unlock the blade, ring 42 is rotated ninety degrees, until passageway 44 aligns with the projection 23 of neck 20, thereby allowing it and the blade to pivot about pin 38 as should be clear from FIGS. 2 and 5.

Thus, it should be understood that the diameter of lock ring 44 is selected so that the central space therewithin is adequate to receive neck 20 therewithin.

Annular raised ridges 50, 52 (FIG. 1) loosely retain lock ring 42 therebetween, i.e., said ridges bar the lock ring from radial travel while allowing facile rotation of said ring. Ridge 50, as shown in FIG. 2, is formed on neck 20 whereas ridge 52 is formed on projection 16 to facilitate assembly of the novel structure.

Figure 11:
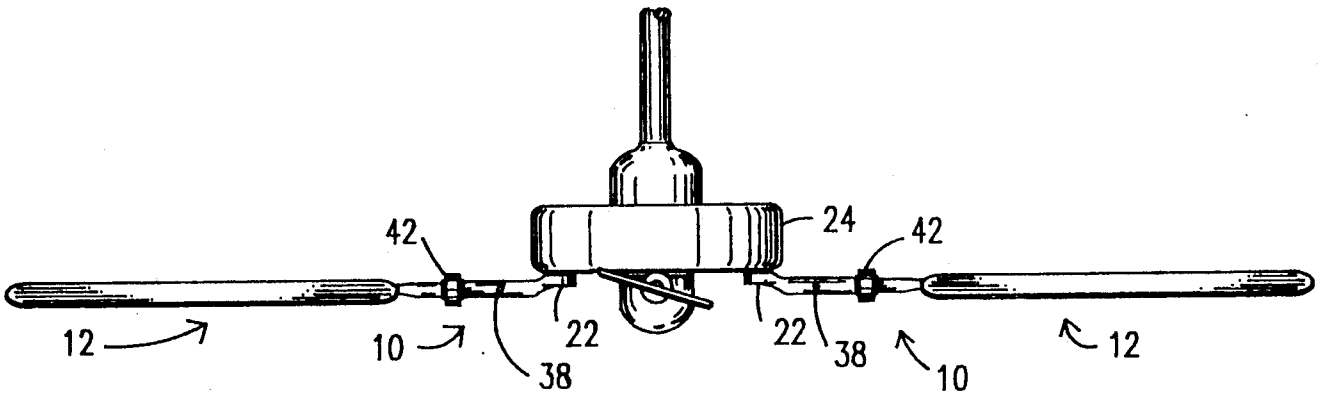
FIG. 11 shows a bottom-mounted fan construction.
Figure 12:
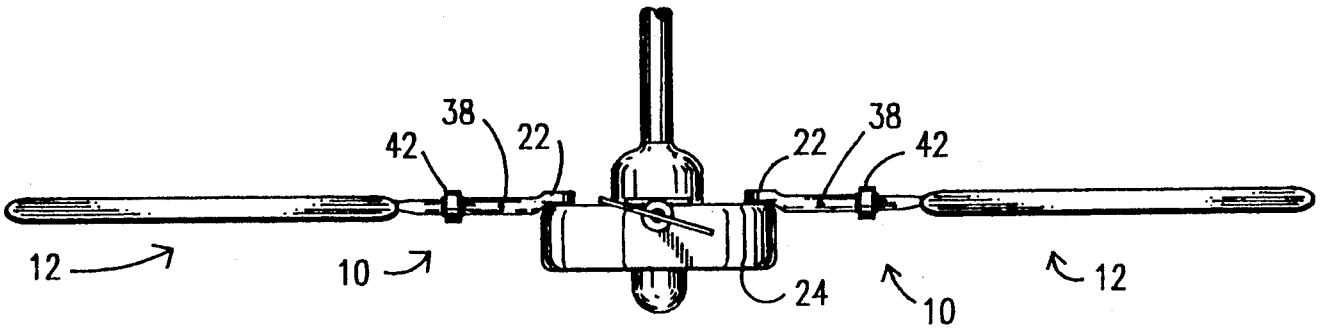
FIG. 12 shows a top-mounted construction.

Note in FIGS. 11 and 12 that pin 38 is positioned radially outwardly of housing 24, thereby enabling articulation of each blade whether the drive ring 21 is top or bottom-mounted.

A second embodiment of the invention is disclosed in FIGS. 6–9. In this embodiment, the mounting bracket for the blade is not articulated; instead, the mounting bracket is separated into two releasably interconnected parts, i.e., the blade end thereof is releasably coupled to the motor end thereof.

Figure 6:
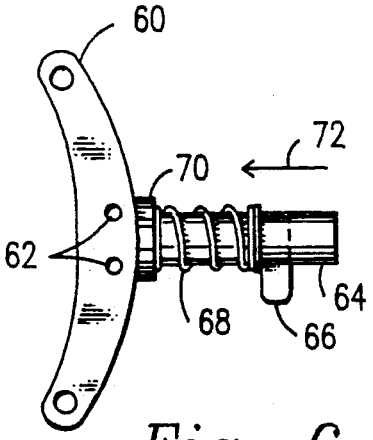
FIG. 6 is an elevational view of the radially inward part of the mounting bracket of the second embodiment of this invention.
Figure 7:
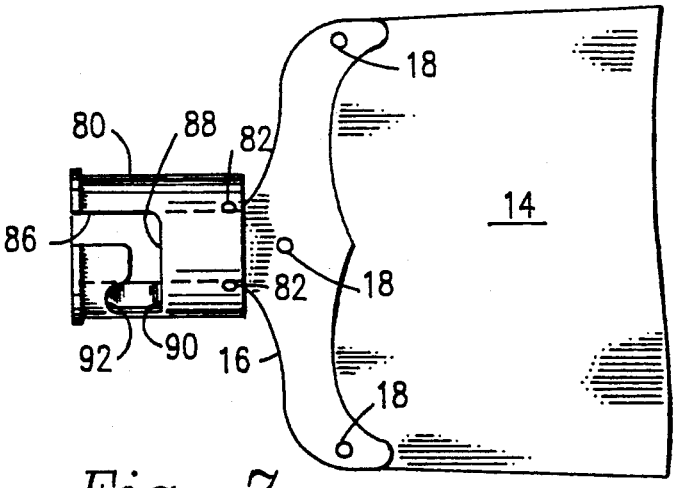
FIG. 7 is an elevational view of the radially outward part of the mounting bracket of said second embodiment.
Figure 8:
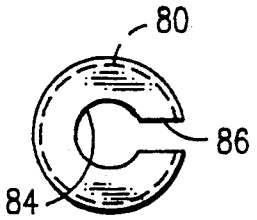
FIG. 8 is a top plan view of the part shown in FIG. 7.

FIG. 6 depicts the motor end of the split mounting bracket or coupling assembly and FIG. 7 depicts the fan end thereof. Mounting bracket 60 is secured by suitable fastening means 62 to neck 64. A fixed position tab 66 extends radially from neck 64. Coil spring 68 is sandwiched between washer 67 and collar 70; thus, it should be understood that spring 68 undergoes compression when washer 67 is displaced toward motor bracket 60, as indicated by directional arrow 72 in FIG. 6, when the fan blade is coupled to said bracket.

Figure 9:
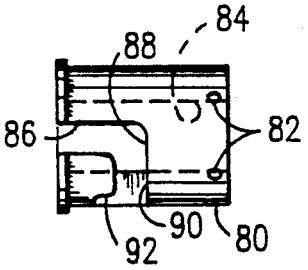
FIG. 9 is a elevational view of the part shown in FIG. 7 without the mounting bracket and fan blade.

FIG. 7 depicts the blade end of the coupling assembly. Blade 14 is secured to mounting bracket 16 as in the first embodiment. A cylindrical housing 80 is secured to the fan end of bracket 16 by suitable fastening means 82. Central bore 84 axially receives neck 64 and slot 86 receives radially extending tab 66 when the fan blade is coupled to the bracket 60. To lock the blade into its operative position, the blade is driven radially inwardly to compress spring 68 and to position tab 66 at the bottom 88 of slot 86 (FIG. 9). Washer 67 engages the rim of housing 80 and causes compression of spring 68. The blade and hence housing 80 are then rotated about the longitudinal axis of the blade and housing so that tab 66 is circumferentially spaced apart from slot bottom 88; said position of the tab 66 is denoted 90 in FIG. 9. The blade is then released and coil spring 68 unloads, driving washer 67 and housing 80 radially outwardly; tab 66 enters into slot 92 formed in housing 80, thereby locking the blade into position. Slot 86 having bottom 88 and having part 92 is thus understood to have a generally "J" shaped configuration. The blade is again driven radially inwardly and rotated in the reverse direction to uncouple the assembly.

The uncoupled blade can then be cleaned at any location by any means.

Figure 10:
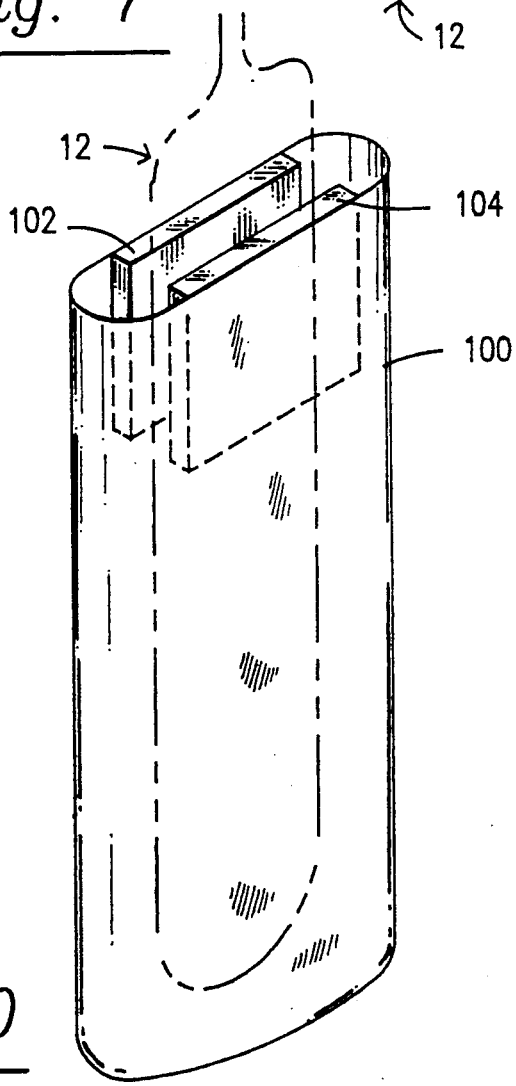
FIG. 10 is a view of the novel bag and cleaning pad means.

FIG. 10 depicts a means for cleaning the blades of the type shown in the first embodiment of the invention. A bag 100 has a longitudinal extent sufficient to receive a fan blade therewithin and has diametrically opposed cleaning pads 102, 104 secured at its mouth as shown. Said pads could also completely encircle the mouth of the bag to perhaps enhance cleaning of the edges of each blade. Thus, it is a simple matter to open the bag, insert it over the blade to be cleaned, press both cleaning pads against the radially innermost end of the blade, and pull the bag to the radially outermost end of the blade while maintaining pressure on both cleaning pads. In this manner, dirt is swept directly into the bag.

This invention is clearly new and useful. Moreover, it was not obvious to those of ordinary skill in this art at the time it was made, in view of the prior art, taken as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An articulated fan blade assembly, comprising:

a mounting bracket having a radially inward, motor end and a radially outward, fan blade end;

a fan blade attached to said mounting bracket at said fan blade end thereof;

an elongate neck interconnecting said motor end and said fan blade end;

a radially extending slot formed in the motor end of said neck;

a radially extending projection formed in the fan blade end of said neck;

said slot receiving said projection;

pin means pivotally interconnecting said motor end and fan blade end of said neck, said pin means being positioned near a radially innermost end of said slot and a radially innermost end of said projection, said fan blade being pivotal about said pin in opposite directions;

lock ring means positioned in encircling relation to said mounting bracket neck, radially outwardly of said pin means;

said lock ring means having a generally toroidal configuration and having a passageway of predetermined circumferential extent that is cut away therefrom;

a central opening being defined by said lock ring means;

said cut away part defining a passageway into and out of said central opening;

said predetermined circumferential extent of said passageway being sufficient to accept passage of said projection into and out of said central opening;

said fan blade being pivotal about said pin means only when said passageway and said projection are in registration with one another;

whereby misalignment of said passageway and said projection when said projection is positioned within said central opening maintains said fan blade in an operable position; and whereby alignment of said passageway and said projection allows said fan blade to be rotated about said pin means.

2. The fan blade assembly of claim 1, further comprising a pair of raised ridges disposed in closely spaced relation to said lock ring means, radially inwardly and radially outwardly thereof, to bar radially directed travel of said lock ring means along the extent of said mounting bracket neck.

3. The fan blade assembly of claim 1, further comprising a drive ring member, rotatable by a motor means, to which the respective motor ends of a plurality of fan blades are secured in circumferentially spaced relation to one another, wherein said drive ring member is selectively positioned above or below a housing for said motor means, and wherein said pin means is positioned radially outwardly of said housing.

* * * * *